United States Patent [19]

Niemeyer

[11] Patent Number: 4,684,773

[45] Date of Patent: Aug. 4, 1987

[54] GAS-BLAST SWITCH

[75] Inventor: Lutz Niemeyer, Birr, Switzerland

[73] Assignee: BBC Brown, Boveri & Company, Limited, Baden, Switzerland

[21] Appl. No.: 769,706

[22] Filed: Aug. 27, 1985

[30] Foreign Application Priority Data

Oct. 10, 1984 [CH] Switzerland ..... 4864/84

[51] Int. Cl.[4] ..... H01H 33/70

[52] U.S. Cl. ..... 200/148 R; 200/148 B; 200/150 B; 200/148 C

[58] Field of Search ..... 200/148 B, 148 R, 150 B, 200/148 C

[56] References Cited

U.S. PATENT DOCUMENTS 4,259,555 3/1981 Kii ..... 200/148 B

*Primary Examiner*—Robert S. Macon

*Attorney, Agent, or Firm*—Burns, Doane, Swecker & Mathis

[57] ABSTRACT

A gas-blast switch preferably suitable for the switching of medium voltage has two switch pieces interacting in an insulating gas filled housing. A fixed switch piece is provided with a hollow space which is connected via channels to a pressure reservoir coaxially encircling the switch pieces. The pressure reservoir during switching-off, can be connected to an arc chamber terminated at least partially on its outer side by an insulating body.

In this switch, a build up of pressure which is adequate to quench the arc is to be achieved at low currents by simple means and an excessive build up of pressure at high currents is to be avoided.

This is achieved when the insulating body is made as an insulating nozzle and has a gas inlet, which can be connected to the pressure reservoir, and a gas outlet which is located between a narrow point of the insulating nozzle and the free end of the fixed switch piece. This gas outlet is connected via further channels to an expansion space and, during switching-off, is cleared by the movable switch piece before the gas inlet.

10 Claims, 2 Drawing Figures

GAS-BLAST SWITCH

BACKGROUND OF THE INVENTION

The invention relates to gas-blast switches of the type having a housing filled with insulating gas and two switch pieces movable relative to each other along an axis.

One type of switch in the prior art described, for example, in the German Patent Specification No. 2,811,508. In known switches, quenching gas heated up by the switch arc is led into a pressure chamber in which it blows the switch arc into the expansion chamber while under high pressure after the release of a discharge opening. So that such a switch works satisfactorily within a wide amperage range, it is necessary that a device be provided which essentially consists of a tube-shaped extension and interacts with the movable switch piece and allows the quenching gas located in the pressure chamber to escape in delayed manner into the expansion chamber and also that the outer part of the pressure chamber be protected against excessive pressures by a valve.

OBJECTS AND SUMMARY OF THE INVENTION

The invention, achieves the object of creating a gas-blast switch in which a pressure build-up which is too small in the case of low currents and a pressure build-up which is too large in the case of high currents is avoided by simple means.

In the gas-blast switch according to the invention, the switch arc in the high-current phase is considerably limited by suitable guidance of the quenching gas flow, so as to then expand, depending on the current, to a more or less considerable extent in its arc portion located downstream. During this procedure, a pressure is built up in the pressure reservoir by the arc gas flowing in the axial direction. This ensures that when low currents are switched a large portion of the arc gas is available for building up pressure. Additional measures for delaying the quenching gas flow are therefore unnecessary. With high currents, on the other hand, a portion of the arc gas is discharged into the expansion chamber. By this means, it is no longer necessary to take precautions, by which means it is ensured that the pressure reservoir, during the switching of short-circuit currents, is not pressurized at too high a pressure.

BRIEF DESCRIPTION OF THE DRAWINGS

A preferred embodiment of the invention is illustrated in the accompanying drawings, in which.

DETAILED DESCRIPTION

Figure 1:
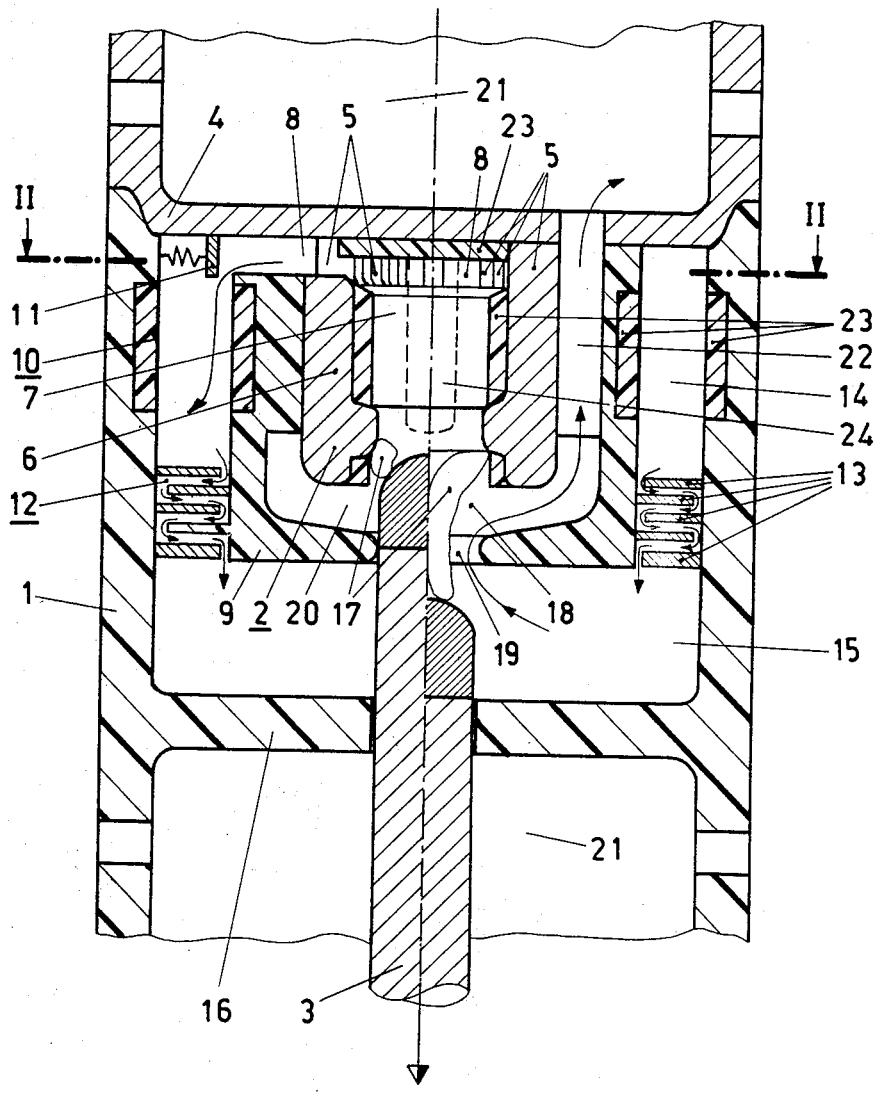
FIG. 1 is a cross-sectional view of the gas-blast switch according to the invention, with the condition shortly after the separation of the switch pieces being shown in the left hand half and the condition during the blow-out of the switch arc being shown in the right hand half.

In FIG. 1, 1 designates an essentially hollow-cylindrically made housing of insulating material. This housing is filled with insulating gas, such as, for example, sulphur hexafluoride of a few bar pressure. It contains two switch pieces 2 and 3 which are movable relative to one another along an axis. The switch piece 2 is supported on a current terminal 4 and contains a ring of contact fingers 5 and 6 which define a hollow space 7 in the switch piece 2. The switch piece 3 is made fully cylindrical and movable along the cylindrical axis. In the switch-on position of the switch, it is moved into the hollow space 7 and contacts at its outer surface the inner surfaces of the contact fingers 5 and 6. The contact fingers 6, at their ends facing away from the free end of the switch piece 2, are slightly shorter than contact fingers 5 and in this way leave open channels 8 in the switch piece 2, which channels 8 extend in the radial direction through an insulating nozzle 9, preferably made of polytetrafluoro-ethylene (PTFE), into an annularly made pressure reservoir 10 coaxially encircling the switch pieces 2 and 3. One-way valves 11 are located at the mouths of the channels 8 into the pressure reservoir 10, which one-way valves 11, in the event of a pressure drop in the hollow space 7, close the pressure reservoir 10 with respect to the hollow space 7.

The pressure reservoir 10 is essentially defined by the housing 1 and the outer generated surface of the insulating nozzle 9 and subdivided by a flow labyrinth 12. This can consist, for example, of radial, annular deflector plates 13 which are offset relative to one another in the axial direction and are fixed alternately to the inner wall of the housing 1 and the outer generated surface of the insulating nozzle 9. The deflector plates 13 have free ends and thus define a flow channel, running in a meander shape, for heated-up quenching gas which is guided during the heating process from the hollow space 7 via the channels 8 and an annular subspace 14 of the pressure reservoir 10 into a further annular subspace 15 of the pressure reservoir 10. The subspace 15 is defined essentially by the housing 1, the insulating nozzle 9, an essentially radially extending housing projection 16 which is penetrated in gas-tight manner by the switch piece 3. The subspace 15, during switching off, is connected to an arc chamber 18, which is located between the free ends of the separating switch pieces 2 and 3, adjoins the hollow space 7 and accommodates the switch arc 17, as soon as the switch piece 3 penetrating the narrow point 19 of the insulating nozzle 3 in an essentially gas tight manner, has cleared this narrow point.

Figure 2:
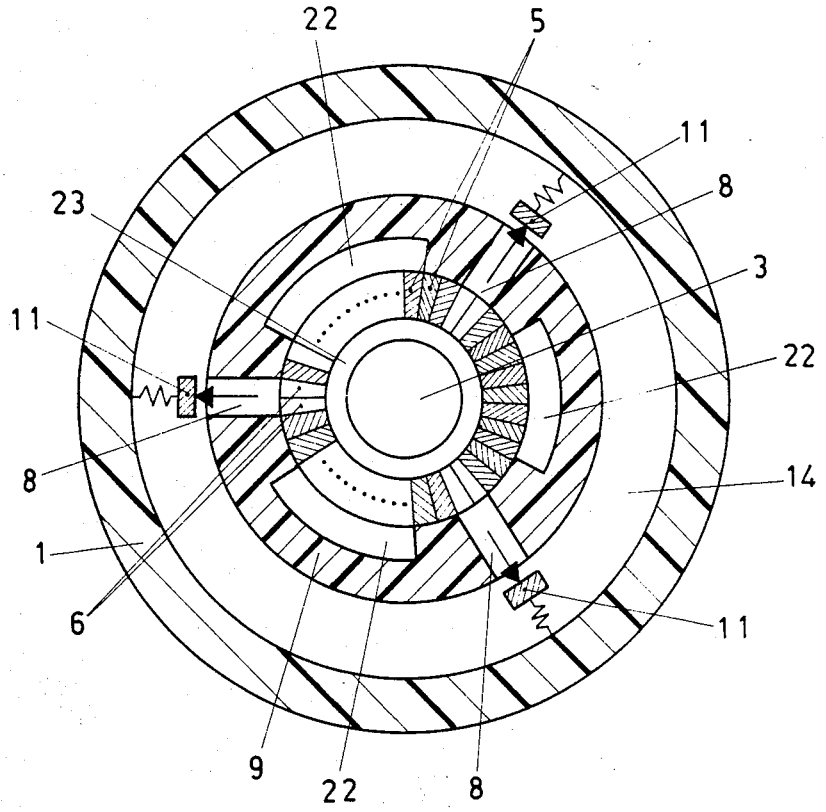
FIG. 2 is a cross-sectional view along the line II—II through the gas blast switch according to FIG. 1.

An annular space 20 is located between the narrow point 19 of the insulating nozzle 9 and the free end of the fixed switch piece 2, which annular space 20, during switching off, is already connected to the arc chamber 18 before the subspace 15. The annular space 20 is part of a connecting path from the arc chamber 18 to an expansion chamber 21. This connecting path, apart from the annular space 20, also contains channels 22 led in the axial direction which—as can be seen from FIG. 1—cross over the channels 8. It can be seen in FIG. 2 that the channels 8 and 22 are arranged in radially and axially running material cutouts, respectively, of the insulating nozzle 9. In this connection, as viewed in the peripheral direction of the insulating nozzle 9, radially and axially extending material cutouts follow each other alternately. During switching off, this causes heated-up insulating gas to flow in a particularly uniform manner through the arc chamber 18.

The hollow space 7 and the subspace 14 of the pressure reservoir 10 are at least partially provided with a material lining 23 which, compared with the material of the contact fingers 5 and 6 of the switch piece 2, has a comparatively low thermal conductivity, a low enthalpy of vaporization and a low boiling point, and, during arc action, vaporizes very easily with formation of an arc-quenching gas. In this connection, these material linings 23 are arranged in such a way that the change in geometry caused by the appearance of the switch arc 17 as a result of material vaporization exerts no essential effect on the flow characteristic of the arc plasma from the hollow space 7 into the pressure reservoir 10.

The material linings 23 preferably contain polymers which are low in hydrogen or hydrogen-free on the basis of halogeno-carbon with a fine-grained filler material, such as, for example, carbon or metal sulphides. Particularly to be recommended in manufacturing the material linings 23 from polytetrafluoroethylene with fine-grained powder fillings of preferably 1–15 percent by weight of zinc, 3–30 percent by weight of molybdenum disulphide or 7–15 percent by weight of graphite or carbon.

The material lining located at the upper end face of the hollow cylinder 7—as can be gathered from FIG. 1—can be made as a pin 24. The movable switch piece 3 must then be made hollow, so that the pin 24 can penetrate into the switch piece 3 in the switched-on position.

The mode of operation of the gas-blast switch according to the invention is now as follows: during switching off, the switch piece 3 is moved downwards. As soon as the two switch pieces 2 and 3 separate, the switch arc 17 is drawn between their free ends (left hand half of FIG. 1). The heat output of the switch arc flows via the hollow space 7, the channels 8 and through the open one-way valves 11 into the pressure reservoir 10 and leads in this location to a build-up of pressure. At the same time, a portion of heat output discharges through the channels 22 into the expansion chamber 21.

As the stroke increases, the heat output of the switch arc 17 is increased. In spite of increasing discharging of arc plasma into the expansion chamber 21, a considerable portion of the arc plasma flows as before into the pressure reservoir 10. This portion is all the greater the smaller is the current.

Because of the non-return valves 11, a backflow of the gas located in the pressure reservoir 10 is prevented from entering through the channels 8 when there is a fall in current and the pressure drop connected with this in the hollow space 7.

In addition, because of the material lining 23, as little arc heat as possible and thus heat output is lost by thermal dissipation onto the inner side of the contact fingers, and material vaporizes to a considerable extent from these linings under the effect of the hot plasma and the radiation of the switch arc 17. This is especially of advantage during the switching of low currents, because in this way the pressure of the quenching gas located in the pressure reservoir 10 is additionally increased. However, a further effect of the material linings 23 can also be that commutation which may be required of the switch arc 17 from the contact fingers 5 and 6 of the switch piece 2 to a further contact (not shown in FIG. 1) is facilitated. Such a contact can be connected to the current terminal 4 in electrically conducting manner and be made, for example, as a ring arranged in the area of the narrow point 19 of the insulating nozzle 9. In this connection, it is of advantage if a material lining in the form of the pin 24 is provided, and the movable switch piece 3 is of hollow design and encloses the free end of the pin 24 in the switch-on position. With such a design of the gas-blast switch, a vapour current is produced by the switch arc 17 during the switching off, shortly after the separation of the two switch pieces 2 and 3, which vapour current is directed from the contact fingers 5 and 6 towards the further contact located at the narrow point 19 of the insulating nozzle and consequently essentially facilitates the commutation of the switch arc 17.

As soon as the switch piece 3 clears the narrow point 19 of the insulating nozzle 9, the gas under excess pressure in the subspace 15 of the pressure reservoir 10 flows through the narrow point 19 of the insulating nozzle 9 and contracts the switch arc 17 at the narrow point 19 (right-hand half of FIG. 1). In this way, not only is the burning-off of the insulating nozzle 9 reduced, but at the same time the switch arc 17 behind the narrow point 19 is automatically considerably expanded by the switch piece 2. This leads to a magnetic pressure gradient in the direction of the hollow space 7. The switch arc 17 therefore acts like a pump which sucks cold gas out of the subspace 15 and conveys it back at increased pressure as arc plasma into the hollow space 7 and thus via the channels 8 into the pressure reservoir 10.

The flow labyrinth 12 prevents the hot gas fed out of the arc zone via the hollow space 7 and the channels 8 into the subspace 14 of the pressure reservoir 10 from mixing with the cold quenching gas displaced into the subspace 15. By this means, the arc in the area of the narrow point 19 is only blown out of the subspace 15 by cold quenching gas.

By means of the mechanism described above, therefore, excess pressure is maintained in the pressure reservoir 10 even during the switching of low currents, cool and uncontaminated quenching gas is supplied to the arc chamber 18, and, during the switching-off of high currents, the build up of pressure in the pressure reservoir 10 is limited by blowing off the excessive arc gas, located in the arc chamber 18, via the annular space 20 and the channels 22 into the expansion space 21.

I claim:

1. A gas blast switch, comprising:

first and second switch pieces, said first switch piece having a hollow space therein, said second switch piece being movable in an axial direction relative to said first switch piece, said second switch piece being received in said hollow space in a switch-on position;

a pressure reservoir encircling said switch pieces, said pressure reservoir being in fluid communication with said hollow space;

an insulating body having a nozzle through which said second switch piece extends when in its switch-on position;

an arc chamber located within said insulating body between said nozzle and said first switch piece, said chamber being in fluid communication with said hollow space in a switch-off position; and an expansion chamber, said expansion chamber being in fluid communication with said pressure reservoir and said arc chamber in the switch-off position, said nozzle having a narrow opening and including a gas inlet passage communicating said hollow space with said pressure reservoir, and said insulating body and first switch piece coacting to form a gas outlet passage between said narrow opening and said first switch piece; whereby said second switch piece moves from the switch-on to the switch-off position said expansion chamber is in fluid communication with said hollow space via said gas outlet passage before said pressure reservoir is in fluid communication with said hollow space via said gas inlet passage.

2. Gas-blast switch according to claim 1, and further including first channels connecting the hollow space and the pressure reservoir and having second channels connecting the arc chamber and the expansion chamber, and wherein the first and second channels run crosswise.

3. Gas-blast switch according to claim 2 wherein the insulating nozzle has material cutouts defined therein for accommodating the first and second channels, said material cutouts accommodating the first channels extending essentially radially from said axial direction and the material cutouts accommodating the second channels extending essentially parallel to said axial direction.

4. Gas-blast switch according to claim 3, wherein said radially and axially extending material cutouts follow each other alternately in a plane transverse to said axial direction.

5. Gas-blast switch, comprising:

first and second switch pieces having a hollow space therein, said second switch piece being movable in an axial direction relative to said first switch piece, said second switch piece being received in said hollow space in a switch-on position;

a pressure reservoir encircling said switch pieces, said pressure reservoir being in fluid communication with said hollow space;

an insulating body having a nozzle through which said second switch piece extends when in its switch-on position;

an arc chamber located within said insulating body between said nozzle and said first switch piece, said chamber being in fluid communication with said hollow space in a switch-off position;

an expansion chamber, said expansion chamber being in fluid communication with said pressure reservoir and said arc chamber in the switch-off position, said nozzle having a narrow opening and including a gas inlet passage communicating said hollow space with said pressure reservoir, and a gas outlet passage between said narrow opening and said first switch piece; whereby as said second switch piece moves from the switch-on to switch-off position an end of the second switch piece forms a gas inlet with said narrow opening and continued movement to the switch-off position places the expansion chamber in fluid communication with said pressure reservoir and said arc chamber;

first channels connecting the hollow space and the pressure reservoir and having second channels connecting the arc chamber and the expansion chamber, and wherein the first and second channels run crosswise; and one-way valves located in the first channels, said oneway valves being connected so that, when there is a pressure drop in the hollow space, a return flow of quenching gas from the pressure reservoir is prevented.

6. A gas blast switch, comprising:

first and second switch pieces, said first switch piece having a hollow space therein, said second switch piece being movable in an axial direction relative to said first switch piece, said second switch piece being received in said hollow space in a switch-on position;

a pressure reservoir encircling said switch pieces, said pressure reservoir being in fluid communication with said hollow space;

an insulating body having a nozzle through which said second switch piece extends when in its switch-on position;

an arc chamber located within said insulating body between said nozzle and said first switch piece, said chamber being in fluid communication with said hollow space in a switch-off position;

an expansion chamber, said expansion chamber being in fluid communication with said pressure reservoir and said arc chamber in the switch-off position, said nozzle having a narrow opening and including a gas inlet passage communicating said hollow space with said pressure reservoir, and a gas outlet passage between said narrow opening and said first switch piece; whereby as said second switch piece moves from the switch-on to the switch-off position an end of the second switch piece forms a gas inlet with said narrow opening and continued movement to the switch-off position places the expansion chamber in fluid communication with said pressure reservoir and said arc chamber; and a flow labyrinth located in the pressure reservoir, said flow labyrinth subdividing the pressure reservoir into two subspaces.

7. Gas-blast switch according to claim 6, wherein the flow labyrinth is made of a material which is a good thermal conductor.

8. A gas blast switch, comprising:

first and second switch pieces, said first switch piece having a hollow space therein, said second switch piece being movable in an axial direction relative to said first switch piece, said second switch piece being received in said hollow space in a switch-on position;

a pressure reservoir encircling said switch pieces, said pressure reservoir being in fluid communication with said hollow space;

an insulating body having a nozzle through which said second switch piece extends when in its switch-on position;

an arc chamber located within said insulating body between said nozzle and said first switch piece, said chamber being in fluid communication with said hollow space in a switch-off position;

an expansion chamber, said expansion chamber being in fluid communication with said pressure reservoir and said arc chamber in the switch-off position, said nozzle having a narrow opening and including a gas inlet passage communicating said hollow space with said pressure reservoir, and a gas outlet passage between said narrow opening and said first switch piece; whereby as said second switch piece moves from the switch-on to the switch-off position an end of the second switch piece forms a gas inlet with said narrow opening and continued movement to the switch-off position places the expansion chamber in fluid communication with said pressure reservoir and said arc chamber; and material linings made of a composition including polymers on the basis of halogeno-carbon and a powdery filler material located in the hollow space and in channels from the hollow space to a subspace of the pressure reservoir.

9. Gas-blast switch according to claim 8, wherein the material linings are made of a composition including polytetrafluoroethylene and fine-grained powdery fillings selected from the group consisting of 15 percent by weight of zinc, 3–30 percent by weight of molybdenum disulphide and 7–15 percent by weight of graphite or carbon.

10. Gas-blast switch according to claim 8 wherein the material linings include a part defining a pin which is located in and extends in the axial direction into the hollow space and, in the switch-on position of the gas-blast switch, is moved into a hollow portion of the second switch piece.

* * * * *